US010894414B2

(12) United States Patent
Shibata et al.

(10) Patent No.: US 10,894,414 B2
(45) Date of Patent: Jan. 19, 2021

(54) SERVICE STATIONS WITH REMOVABLE SERVICE MODULES

(71) Applicant: Hewlett-Packard Development Company, L.P., Spring, TX (US)

(72) Inventors: Alan Shibata, Vancouver, WA (US); Levi Holscher, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/493,714

(22) PCT Filed: Mar. 22, 2017

(86) PCT No.: PCT/US2017/023663
§ 371 (c)(1),
(2) Date: Sep. 12, 2019

(87) PCT Pub. No.: WO2018/174875
PCT Pub. Date: Sep. 27, 2018

(65) Prior Publication Data
US 2020/0031130 A1 Jan. 30, 2020

(51) Int. Cl.
*B41J 2/165* (2006.01)

(52) U.S. Cl.
CPC ..... *B41J 2/16547* (2013.01); *B41J 2/16508* (2013.01); *B41J 2/16538* (2013.01); *B41J 2/16541* (2013.01); *B41J 2/16585* (2013.01); *B41J 2/16517* (2013.01)

(58) Field of Classification Search
CPC ..... B41J 2/16547; B41J 2/16508; B41J 2/16538; B41J 2/16541; B41J 2/16585
See application file for complete search history.

(56) References Cited

U.S. PATENT DOCUMENTS

| | | | | |
|---|---|---|---|---|
| 6,973,433 | B2 | 12/2005 | Haug | |
| 7,029,093 | B2 | 4/2006 | Tee et al. | |
| 7,128,389 | B2 | 10/2006 | Okamoto et al. | |
| 7,699,432 | B2 * | 4/2010 | Simmons | B41J 23/025 347/32 |
| 8,770,713 | B2 | 7/2014 | Kyoso | |
| 8,851,628 | B2 | 10/2014 | Love et al. | |
| 8,870,315 | B2 | 10/2014 | Takahashi | |
| 9,168,753 | B2 | 10/2015 | Miyazawa | |
| 2006/0170728 | A1 | 8/2006 | Simmons et al. | |
| 2009/0179976 | A1 | 7/2009 | Nakazawa et al. | |

FOREIGN PATENT DOCUMENTS

EP 1048467 B1 11/2000

* cited by examiner

*Primary Examiner* — Thinh H Nguyen
(74) *Attorney, Agent, or Firm* — HP Inc. Patent Department

(57) ABSTRACT

In an example, a service station may comprise a conveyor movable along or about a conveyor path. Example service station may further comprise a first service module removably installed on the conveyor, and a second service module removably installed on the conveyor. The conveyor may move the first service module and the second service module along the conveyor path. The example service station may further comprise a lifter disposed in a lifting zone along the conveyor path to lift one of the first service module and the second service module from a stowed position to an operating position if the first service module or the second service module is disposed in the lifting zone along the conveyor path.

20 Claims, 5 Drawing Sheets

SERVICE STATIONS WITH REMOVABLE SERVICE MODULES

BACKGROUND

Electronic devices such as imaging devices may perform operations on or with media. Such electronic devices may have a head or beads with which the electronic device performs operations on or with the media. The head or heads may have a nozzle from which print substance may be ejected. Print substance may sometimes block or clog the nozzle. To avoid such blocking, or clogging, nozzles of heads may be serviced or cleaned periodically.

DETAILED DESCRIPTION

Figure 1:
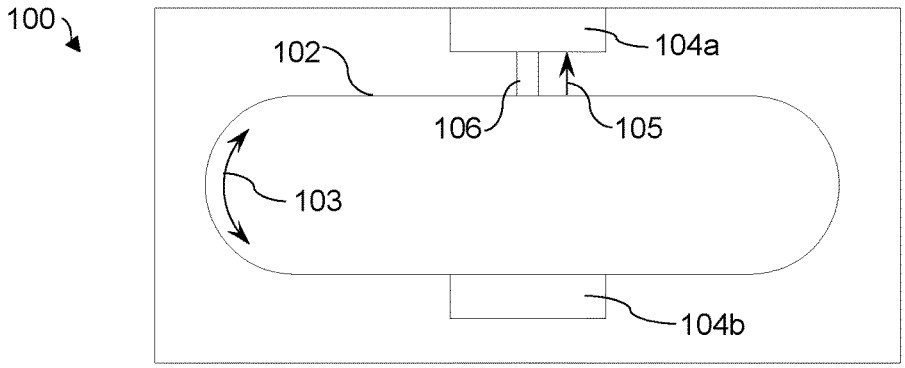
FIG. 1 is a schematic view of an example service station.

Electronic devices such as imaging devices may perform operations on or with print media. Such electronic devices may print, copy, plot, scan, or perform other operations with print media, and, in some situations, may have printheads with which the electronic device performs such operations. Printheads may have a nozzle from which print substance may be ejected. Print substance may sometimes block or clog the nozzle if it is not periodically cleaned off or wiped. To avoid such blocking or clogging, printheads, or nozzles thereof may be serviced or cleaned periodically by a service station of the electronic device.

In some situations, it may be desirable to service the printhead while the printhead is not performing operations on or with print media. Additionally, it may be desirable to have an onboard service station to service the printhead or printheads of the electronic device. In some situations, service stations that are bulky and/or complex may be employed to periodically service the printhead or printheads of the electronic device, but stowage of such a service station while not being used may occupy a relatively large amount of volume within the electronic device, and/or the service station may occupy a relatively large footprint within the electronic device. Further, such a service station may also require the printhead or printheads to move to come to the servicing portion of the service station. Such movement of the printhead or printheads is often only performed during a servicing operation, and, therefore, supporting such movement within the electronic device may create dead volume that is hot useful for any other function. As such, it may be desirable to employ a service station that is compact and occupies a small footprint within the electronic device, and, further, does not necessitate the movement of the printhead in order to perform servicing operations, thereby minimizing dead volume within the electronic device.

Additionally, in some situations, it may be desirable to employ a service station that may carry out or perform a variety of different types of servicing operations on or with the printhead. Previous service stations may be able to carry out a specific operation or a few specific operations to service the printhead, but such individual functions may not be customizable or modular. Therefore, it may be desirable to employ a service station that is modular and may enable the replacement or customization of various removable service modules such that the service station may carry out different operations, or different combinations of operations.

Implementations of the present disclosure provide service stations it removable service modules that may minimize the wasted space within an electronic device. Further, implementations of the present disclosure provide service stations that may perform servicing operations on stationary printheads, thereby eliminating unnecessary dead volume created by printhead movement. Implementations of the present disclosure may also provide service stations that are compact and easily serviceable and/or replaceable. Further, the removable service modules of service stations described herein may be modular, customizable, and easily replaceable and/or interchangeable with each other, thereby enabling the customization of the described servicing operations, or combinations thereof.

Referring now to FIG. 1, a schematic view of an example service station 100 is illustrated. Example service station 100 may comprise a conveyor 102 movable around or about a conveyor path 103. Example service station 100 may further comprise a first service module 104*a* removably installed on the conveyor 102, and a second service module 104*b* removably installed on the conveyor 102. In some implementations, the conveyor 102 may move the first service module 104*a* and the second service module 104*b* around the conveyor path 103. The example service station 100 may further comprise a lifter 106 disposed in a lifting zone along the conveyor path 103, the lifter 106 to lift one of the first service module 104*a* and the second service module 304*b* from a stowed position to an operating position if the first service module 104*a* or the second service module 104*b* is disposed, or is moved by the conveyor 102 into, the lifting zone along the conveyor path 103. In other words, the lifter 106 may move or lift a service module from its stowed position on the conveyor 102 to the operating position upon the respective service module being moved into or becoming disposed within the lifting zone. Such lifting or movement of the service module may be represented by arrow 105, in some implementations. Once disposed in the operating position, the service module may perform a servicing operation. In further implementations, the first service module 104*a* and the second service module 104*b* may be part of a plurality of service modules 104 that may be removably installed on the conveyor 102. Each service module 104 of the plurality of service modules may be movable from the stowed position to the operating position.

Figure 2A:
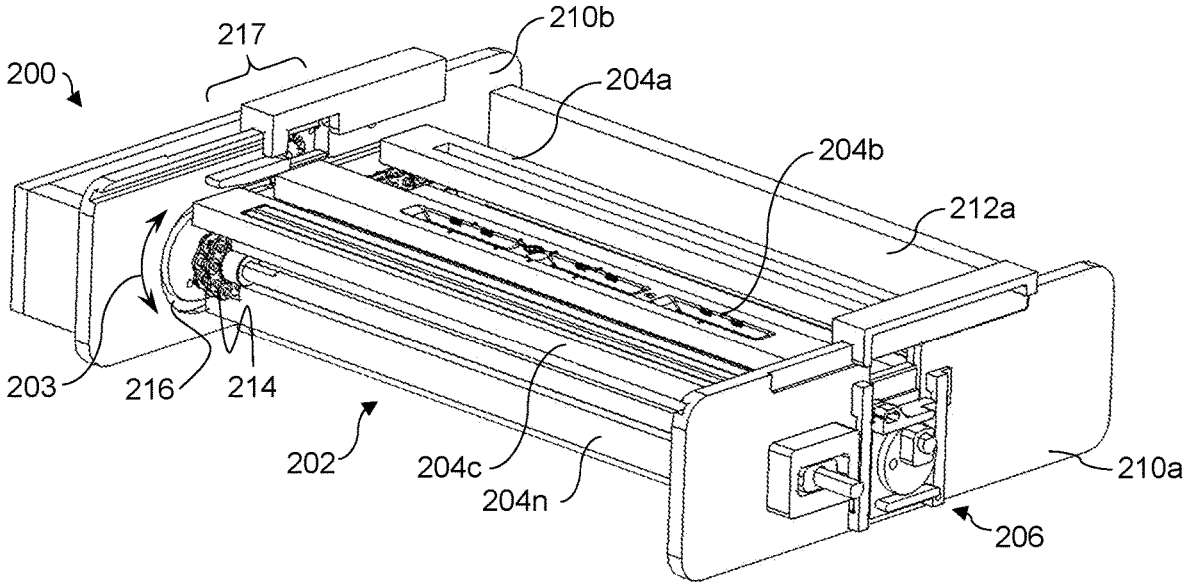
FIG. 2A is a perspective view of an example service station.

Referring now to FIG. 2A, a perspective view of an example service station 200 is illustrated. Example service station 200 may be similar to example service station 100. Further, the similarly-named elements of example service station 200 may be similar in function and/or structure to the respective elements of example service station 100, as they are described above. In some implementations, the example service station 200 may include a structure or housing forming a frame or framework to mechanically support the other elements of the service station 200. Further, such a structure or housing, in some implementations, may include first end plate 210*a* and a second end plate 210*b*, and a first sidewall 212*a* and a second sidewall 212*b* extending in between the first and second end plates. The second sidewall 212*b* is omitted from FIG. 2A for clarity, such that other internal elements may be better illustrated. In other implementations, the service station 200 may include other or different components that may define the structure or housing, and/or may have a different appearance or form. In further implementations, the housing may have a sufficient structure or form so as to enable the service station 200, and the constituent elements thereof, to be removable from an electronic device or an imaging device within which the service station 200 may be disposed.

Example service station 200 may include a plurality of service modules 204*a*, 204*b*, 204*c*, . . . 204*n*. Each service module of the plurality of service modules (hereinafter referred to generally as service module 204) may be disposed on a conveyor 202 of the service module 200. In some implementations, the conveyor 202 may be a separate component from the plurality of service modules 204, i.e., each of the service modules may be placed or installed on to a conveyor belt or other type of conveyance mechanism. In other implementations, the plurality of service members 204 may be arranged together to form the conveyor 202 themselves, i.e.,each service module may be disposed within the service station 200 such that the plurality of service modules, together, move and structurally resemble a conveyor or conveyance system. In further implementations, each service module 204 of the plurality of service modules 204 may be individually removable from/installable on the conveyor, and may be installed anywhere on the conveyor where another service module 204 is not already installed. Additionally, each service module 204 may be attached to the conveyor 202 in any manner that may enable the removability or exchangeability of the service modules 204. The arrangement or order of the service modules 204 on or as part of the conveyor 202 may be customizable or changeable in order to increase the versatility, efficiency, or effectiveness of the service station 200. Further, the conveyor 202 may be expandable to receive and/or mechanically support a larger or smaller number of service modules 204. Thus, the plurality of service modules 204 may be modularly engageable with the conveyor 202, and thus the service station 200.

Each service module 204 may be a component that is suitable to perform a service operation upon a printhead, or a nozzle of a printhead. For example, the plurality of service modules and respective service operations may include, but are not limited to, a wiper module to wipe or clean a printhead, a cap module to cap, cover, or seal a printhead a brush wiper module or wet wiper module to wipe or brush a printhead, a spit module to spit cleaning fluid at or on to the printhead, a spittoon module to receive a spitting operation performed by the printhead, and/or a platen bridge module to occupy a gap or a service bay in a platen of an electronic device. In some implementations, the spittoon may be a stationary component disposed within a central cavity or portion of the conveyor. In such an implementation, the spittoon may be a fluid collection device to receive a spitting operation performed by the printhead. In further implementations, the plurality of service modules 204 may include other types of service modules 204 that perform a service operation on or with the printhead, or would be otherwise useful to have in a service station. In some implementations, the arrangement of the plurality of service modules 204 on the conveyor 202 may be customized so as to increase operational efficiency and versatility of the service station 200. In other words, a specific service module 204 may be strategically placed adjacent to another specific service module 204 on the conveyor, such that one may be used on the printhead immediately after or before the other, possibly with little delay in between.

In some implementations, the conveyor 202 may be movable around or about a conveyor path 203. In implementations wherein the plurality of service modules 204 are arranged in a conveyor-like fashion to define the conveyor 202, the plurality of service modules 204 themselves may be movable about or along the conveyor path 203. The conveyor 202 may move along the conveyor path such that each or any service module 204 of the plurality of service modules 204 may be moved into and out of a lifting zone 217 as needed or desired. In some implementations, the service station 200 may include a drive member 214 to drive or move the conveyor, and thus the plurality of service modules 204, around, about, or along the conveyor path 203. The drive member 214 may be a chain, belt, or another component capable of transmitting motion from a motive element, e.g., a motor, to the conveyor 202 and/or the plurality of service modules 204. In further implementations, the service station 200 may include a track 216 disposed along the conveyor path 203, or a portion thereof. The track 216 may be a groove, slot, or channel, or have another structure suitable to constrain the conveyor 202 to movement along the conveyor path 203. The drive member 214 may drive the plurality of service modules 214 around the track 216 to move the plurality of service modules 204 around the conveyor path 203.

In some implementations, the service station 200 may further include a lifter 206 to individually lift one of the plurality of service modules 204 from a stowed position to an operating position if the one of the plurality of service modules 204 is disposed in or is moved into the lifting zone 217 along the conveyor path 203. In other words, each of the service modules 204 of the plurality of service modules 204 may be disposed in a stowed position on or as part of the conveyor 202. The conveyor 202 may move along the conveyor path 203 until a desired service module 204 is disposed in the lifting zone 217. The lifter 206 may then move or lift the desired service module 204 that is disposed in the lifting zone 217 from its stowed position to an operating position. In some implementations, the operating position is spaced apart from the conveyor 202. In further implementations, the operating position may be a position wherein the respective service module 204 is able to perform a servicing operation on a printhead of an electronic device. A servicing operation may refer to an action that the respective service module may perform to service a printhead. A servicing operation, in some implementations, may be specific to the type of service module. E.g., the servicing operation of a wiper or wiper module may be to wipe or scrape a printhead or a nozzle thereof. The lifter 206 may have any suitable structure, or include any suitable components to enable the lifter 206 to move any of the plurality of service modules 204 from its respective stowed position on or as part of the conveyor 202, to the operating position.

Figure 2B:
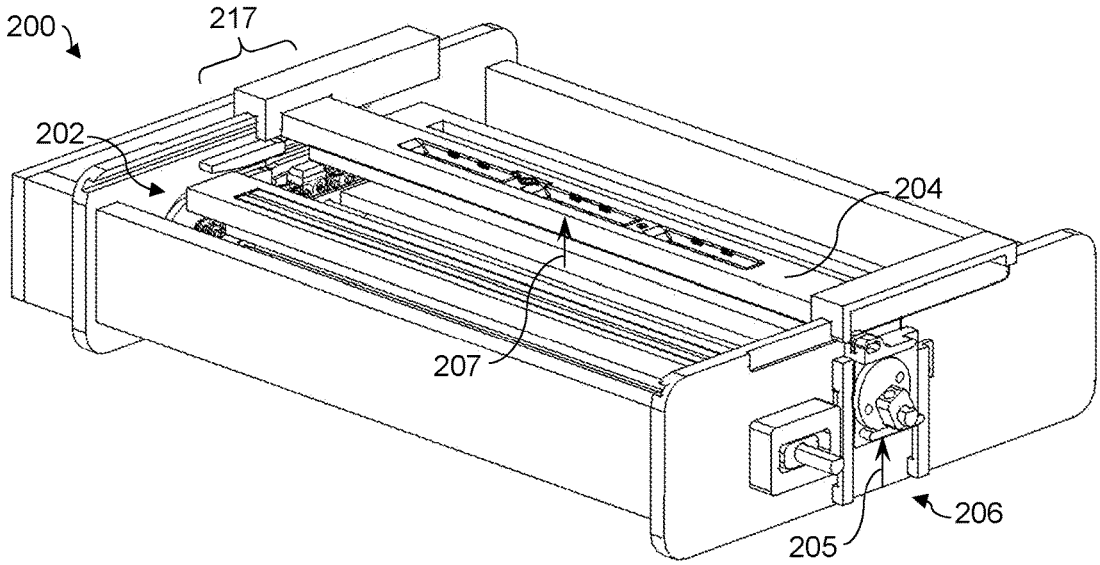
FIG. 2B is a perspective view of an example service station.

Referring additionally to FIG. 2B, a perspective view of example service station 200 is illustrated wherein one service module 204 of the plurality of service modules has been lifted or otherwise moved from its stowed position as part of the conveyor 202 (in this example) to the operating position. Conveyor 202 may have moved along the conveyor path 203 to dispose the service module 204 (illustrated as 204*b* as FIG. 2A) in the lifting zone 217. Lifter 206 has moved in a lifting direction 205 in order to move the service module 204 in a similar lifting direction 207 to dispose the service module 204 in the operating position.

Figure 3A:
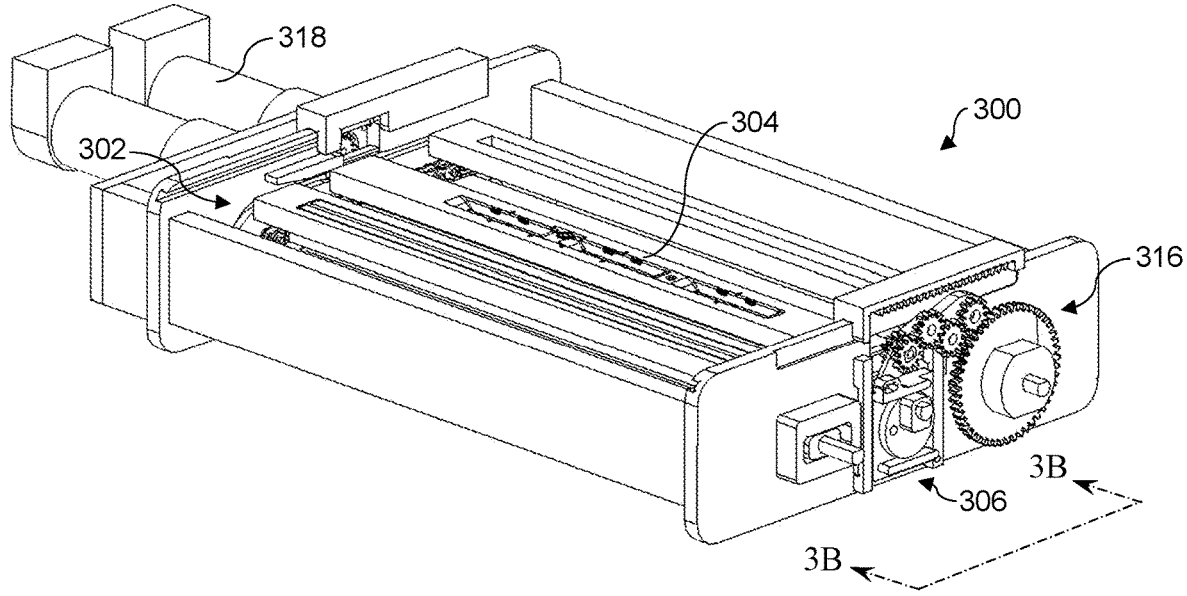
FIG. 3A is a perspective view of an example service station.

Referring now to FIG. 3A, a perspective view of an example service station 300 is illustrated. Example service station 300 may be similar to other example service stations described above. Further, the similarly-named elements of example service station 300 may be similar in function and/or structure to the respective elements of other example service stations, as they are described above. The service station 300 may include a plurality of service modules 304, a lifter 306, and a transmission 316. The transmission 316 may include components including, but not limited to, gears, cogs, belts, chains, torque converters, drive shafts, and/or other suitable components to drive a conveyor 302 of the service station 300, and the plurality of service modules 304 thereon or therein, around a conveyor path. FIG. 3A may only illustrate a single example gear or cog of the transmission 316 for clarity. Further, the service station 300 may include one or multiple motive elements 318. Motive element 318 may be a motor or a similarly suitable component to provide motive power to the transmission 316, and thus the conveyor 302. In some implementations, the transmission 316 may include a drive shaft (not shown) engaging the transmission 316 with a motive element 318 to drive the conveyor 302 around the conveyor path.

Figure 3B:
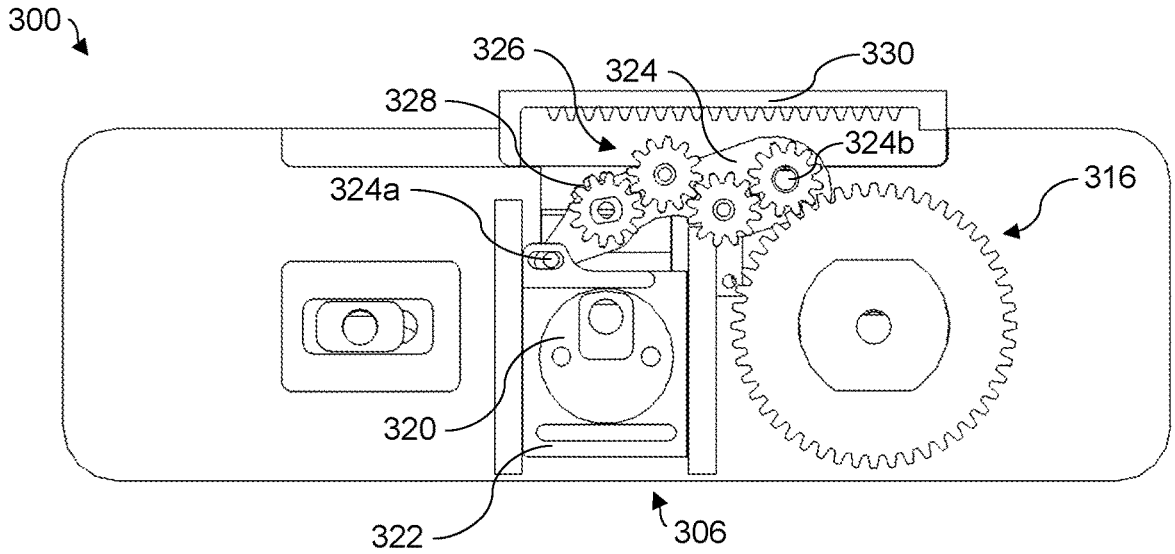
FIG. 3B is a front view of an example service station.

Referring additionally to FIG. 3B, a front view, similar to the view 3B-3B illustrated in FIG. 3A, of the service station 300 is illustrated. In the illustrated example, the lifter 306 may include a slider 322 and a cam 320 engaged with the slider 322. The cam 320 may push the slider 322 from a first position to a second position such that the slider 322 lifts one of the plurality of service modules 304 from a stowed position to an operating position during the transition of the slider 322 from the first position to the second position. In other words, the lifter 306 may lift or otherwise move one of the plurality of service modules 304, as described above, through the movement of the slider 322 from the first position to the second position, in some implementations. FIG. 3A illustrates the slider 322 as being disposed in the first position.

In further implementations, the service station 300 may include an agitator 326. The agitator 326 may move one of the plurality of service modules 304 through an operating motion if the one of the plurality of service modules 304 is disposed in the operating position. Operating motion may refer to a movement of the service module 304 that enables the service module 304 to perform a respective servicing operation upon a printhead that corresponds to the type of service module. For example, if the service module is a wiper or a wiper module, the operating motion may be a side-to-side, reciprocating, or back and forth motion so that the module may wipe or clean the printhead. In other implementations, it is contemplated that a service module 304 may not need an operating motion in order to perform its respective servicing operation. For example, a service module may be a platen bridge module, and the respective servicing operation may be for the platen bridge module to occupy a gap or space in a platen of an imaging device. In such a situation, the platen bride module may not need an operating motion to fulfill its servicing operation. In the illustrated example, the agitator 326 may include an agitator bar 330, a pivot arm 324 having a first end 324*a* engaged with the slider 322 and pivotable about a second end 324*b*, and a drive train disposed on the pivot arm 324 and engaged with the transmission 316 of the service station 300. The drive train may removably engage with the agitator bar 330. The agitator bar 330 may be slidably engaged with the service station 300, or an end plate or other portion thereof, and may engage with the service module 304 that is disposed in the operating position. The agitator bar 330 may engage with the service module 304 so as to move the service module 304 through the operating motion. The pivot arm 324 may pivot or move with the slider 322 as the slider 322 is transitioned from the first position to the second position. The drive train, or a portion thereof, being disposed on the pivot arm 324, may move with the pivot arm 324. The drive train may be a series of gears, cogs, or other drive components that may be suitable to transmit motion from the transmission 316 to the agitator bar 330 such that the agitator bar 330 may move the service module 304 that is disposed in the operating position through the operating motion.

Figure 3C:
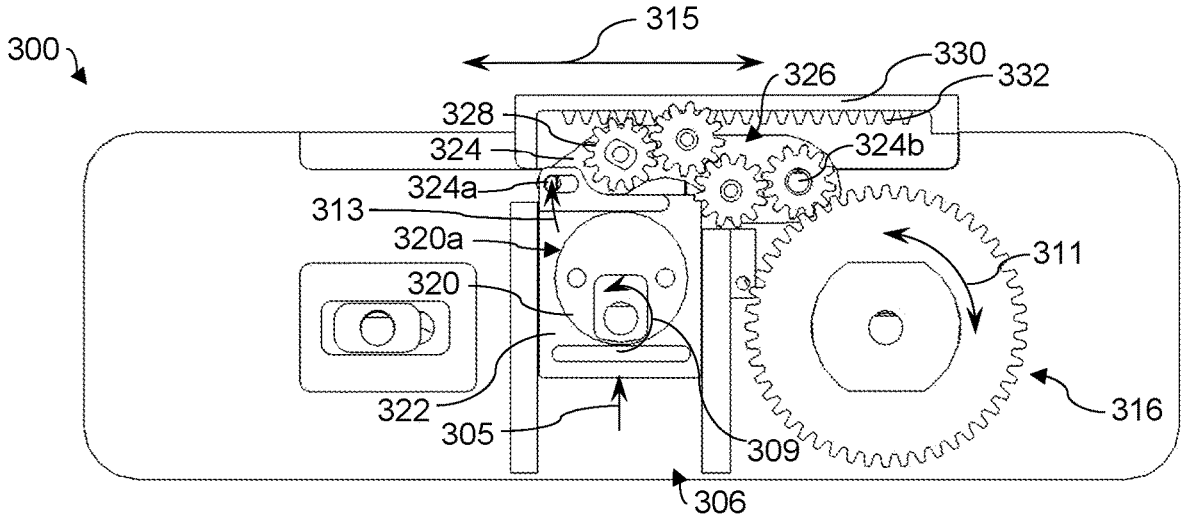
FIG. 3C is a front view of an example service station.

Referring now to FIG. 3C, a front view of the example service station 300 is illustrated, wherein the slider 322 has been transitioned from the first position to the second position. The cam 320 has been moved through a motion similar to that represented by arrow 309. As such, a cam surface 320*a* of the cam 320 has been moved against the slider 322 so as to cause the slider 322 to move in a lifting direction 305. In some implementations, the cam 320 is moved along direction 309 by the motive element 318, or an intermediary component therebetween. In other implementations, the cam 320 is driven along direction 309 by another component of the service station 300 or operably attached thereto. Although not visible in FIG. 3C, a service module 304 of the plurality of service modules 304 has b transitioned from its stowed position with or as part of the conveyor 302, to the operating position by the slider 322 moving from the first position to the second position.

The slider 322, though its engagement with the first end 324*a* of the pivot arm may move the pivot arm 324 about the second end 324*b* during the transition of the slider 322 from the first position to the second position in order to engage the drive train with the agitator bar 330. Such a movement of the pivot arm 324 is represented by arrow 313. FIG. 3C illustrates the drive train as being engaged with the agitator bar 330 after such a movement has occurred. In some implementations, such as the illustrated example, the drive train may include a drive gear 328 to engage with a gear rack 332 of the agitator bar 330 if the drive train is engaged with the agitator bar 330. Once the drive gear 328 is engaged with the gear rack 332, the transmission 316 and the drive train may move the agitator bar through the operating motion 315. In some implementations, the transmission 316 may move similar to the motion represented by arrow 311, and such motion may be transmitted through the drive train to the agitator bar 330 to cause the operating motion 315. Note, in other implementations, the drive train and agitator bar 330 may have a different structure and/or different components than is illustrated, such different components still being able to transmit motion from the transmission 316, or a component attached thereto, to the agitator 326 to cause a service module 304 to be moved through the operating motion 315.

Figure 3D:
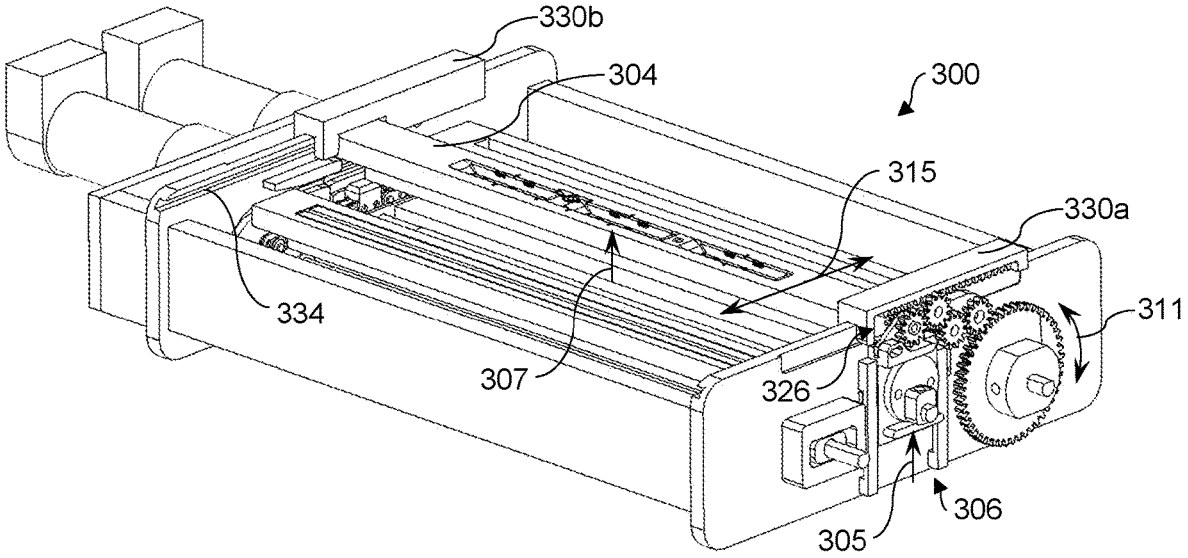
FIG. 3D is a perspective view of an example service station.

Referring additionally to FIG. 3D, a perspective view of the example service station 300 is illustrated wherein the lifter 306 has moved along lifting direction 305, causing a service module 304 within the lifting zone to be lifted along similar lifting direction 307 to dispose the service module 304 in the operating position. Upon being disposed in the operating position, the service module 304 may be engaged with the agitator bar 330 of the agitator 326. In some implementations, the agitator 326 may have a first agitator bar 330*a* to engage with a first end of the service module 304, and a second agitator bar 330*b* to engage with a second end of the service module 304. In such implementations, the agitator 326 structure may be replicated within the service station 300 near the second end of the service module 304, such that both the first agitator bar 330*a* and the second agitator bar 330*b* may, together, move the service module 304 through the operating motion 315. In other implementations, the service station 300 may only have a single agitator 326 and, thus, a single agitator bar 330. After the service module 304 has been moved through its operating motion and/or completed its servicing operation on a printhead or a nozzle thereon, the lifting motion may be substantially reversed in order to lower the service module from the operating position hack to the stowed position, on or as part of the conveyor 302. The conveyor 302 may then move farther along the conveyor path in order to dispose another or a different service module 304 in the lifting zone. The different service module 304 may then be lifted along the lifting direction 307 from its stowed position into the operating position, in order to execute its respective servicing operation.

Figure 4A:
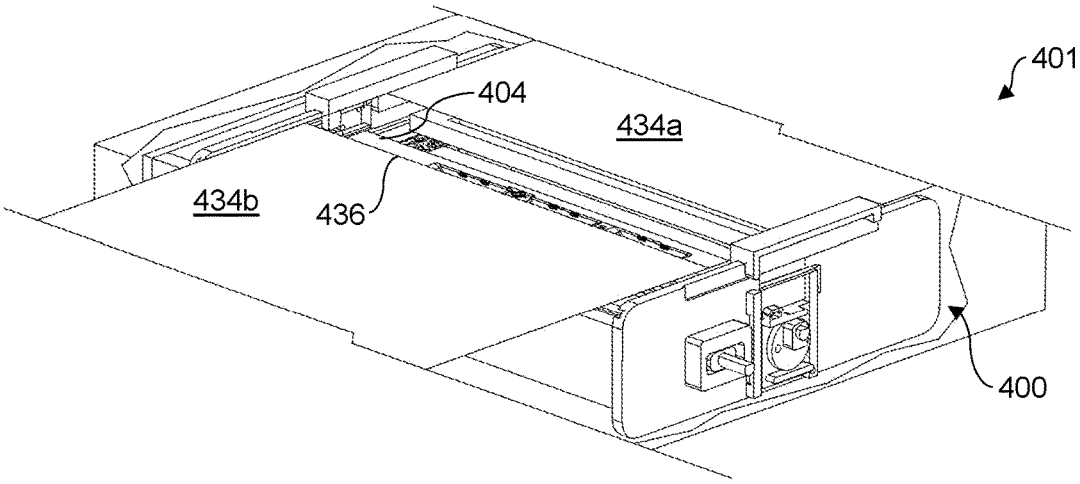
FIG. 4A is a perspective view of an imaging device having an example service station.

Referring, now to FIG. 4A, a perspective view of an imaging device 401 having an example service station 400 is illustrated. FIG. 4A may be a partial cutaway view of an imaging device, with portions of the imaging device omitted or cutaway for clarity. Example service station 400 may be similar to other example service stations described above. Further, the similarly-named elements of example service station 400 may be similar in function and/or structure to the respective elements of other example service stations, as they are described above. The imaging device 401 may be an electronic device and may perform operations on or with print media. In some implementations, the imaging device 401 may be a printer, copier, scanner, plotter, or another electronic device to perform operations on or with print media. In this context, print media may refer to paper, cardboard or card stock, latex, vinyl, or another material suitable for use in an imaging device. In some implementations, the electronic device may be a three-dimensional (3D) printer. In such implementations, the print media may refer to a base, substrate, or another material upon which 3D print material, such as a powder for example, may be deposited.

In some implementations, imaging device 401 may include a platen (referred to generally as platen 434), which may include a first portion 434*a* and a second portion 434*b*. The platen 434, and the first and second portions thereof, may be a base or substrate over which print media may be disposed or delivered in or through a print zone of the imaging device. In further implementations, the imaging device, or the platen 434 thereof, may include a service bay 436, which may be disposed in between the first portion 434*a* and the second portion 434*b*. The service bay 436 may be a gap, break, slot, or another type of opening in the platen, through which the example service station 400 may perform servicing operations.

In some implementations, the service station 400 may be disposed, at least partially, underneath the platen 434. In further implementations, the service station 400 may include a plurality of service modules disposed on a conveyor or arranged in a conveyor-type manner to define a conveyor. The service station 400 may also include a lifting zone substantially disposed beneath and aligned with the service bay 436. In this context, substantially may refer to the lifting zone and the service bay 436 occupying enough of the same vertical volume such that a service module of the plurality of service modules may be disposed in the lifting zone and lifted from underneath the platen to a position disposed through or in the service bay 436.

Figure 4B:
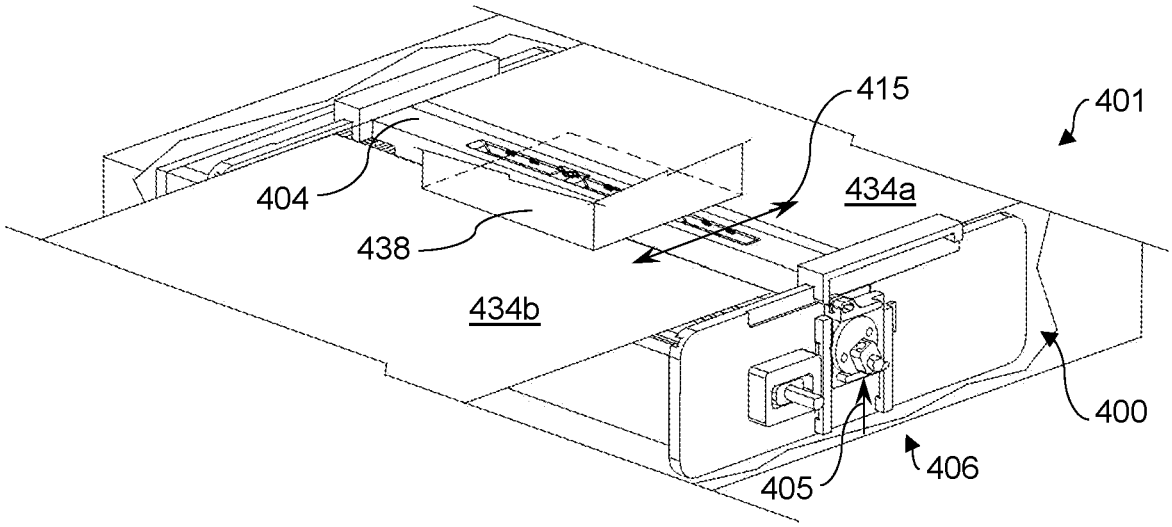
FIG. 4B is a perspective view of an imaging device having an example service station.

Referring now to FIG. 4B, a partial cutaway perspective view of imaging device 401 is illustrated. In some implementations, each service module 404 of the plurality of service modules 404 may be movable between a stowed position, on or part of the conveyor underneath the platen 434, and an operating position, in the service bay 436. In other words, the plurality of service modules 404 may be disposed underneath the platen 434 in the stowed position, and may be disposed in the service bay 436 in the operating position. In some implementations, a service module disposed in the operating position may extend, at least partially, through the service bay 436, or, in contrast, the respective service module 404 may be raised from the conveyor, yet still be below the platen 434 in the service bay 436 while the operating position.

The imaging device 401 may include a printhead 438, with the platen 434 disposed underneath the printhead 438 in some implementations. The printhead 438 may be partially cut away or hidden for clarity in FIG. 4B. The printhead 438 may eject a print fluid on to the print media when print media is disposed in the print zone, between the printhead and the platen 434. In some implementations, the printhead 438 may have a nozzle from which the print fluid may be ejected. In some implementations, the printhead 438 may be a print bar having multiple printheads author nozzles. In further implementations, the printhead may be a print bar that extends across an entire width of print media, sometimes referred to as a page-wide array of printheads. The print fluid may be a print substance with which the imaging device performs operations on or with the print media. In some implementations, the print fluid may be ink, or a substance having pigment suspended in a carrier fluid. In implementations wherein the imaging device is a 3D printer, the print fluid may actually be a 3D print substance, such as a powder, resin, or another type of 3D print substance.

FIG. 4B may illustrate one of the plurality of service modules 404 as being disposed in the operating position. The service station 400 may include a lifter 406 that may lift one of the plurality of service modules from its respective stowed position underneath the platen to the operating position within the service bay 436 when the service module 404 is moved into the lifting zone. Thus, the movement of the service module 404 into the operation zone may bring the service module 404 sufficiently close to the printhead, or a nozzle thereon, to perform a servicing operation and avoid the need for the printhead to move towards the service module. In other words, the printhead may remain stationary and still be serviced by the service station 400. Once disposed in the operating position, the service module 404 may be oscillated, reciprocated, or otherwise moved through an operating motion 415 by the service station 400, or sometimes by an agitator thereof. The service module 404 may perform a servicing operation upon the printhead 438, or a nozzle thereof, throughout the operating motion. It should be noted that the service module 404 may be of a type that does not need to undergo an operating motion in order to execute its respective servicing operation, in some implementations.

In some implementations, each of the service modules 404 of the plurality of service modules 404 may be individually removable from the service station 400, or the conveyor therein. In further implementations, each of the service modules 404 of the plurality of service modules 404 may be a different type of service module 404 from the other service modules 404. In yet further implementations, one of the plurality of service modules 404 may be a platen bridge module. The platen bridge module may be sufficiently structured and sized so as to fit within the service bay 436 when the platen bridge module is disposed in the operating position. Additionally, the platen bridge module may be disposed flush or substantially even with the platen 434, or the first and/or second portions thereof, within the service bay 436 if the platen bridge module is disposed in the operating position. In some implementations, another of the plurality of service modules 404 may be a wiper or a wiper module. The wiper module may wipe or scrape the printhead 438, or a nozzle thereof, if the wiper module is disposed in the operating position.

After the service member 404 executes or carries out its servicing operation on the printhead the service module may be lowered back down from the operating position to its stowed position on or as part, of the conveyor. Once the service module 404 is lowered hack to its stowed position beneath the platen 434, the imaging device may start or resume performing operations on or with print media, and deliver print media over the platen 434 through the print zone, in implementations wherein the service station 400 has a service module 404 that is a platen bridge module, after another service module 404 has finished executing its servicing operation on the printhead and lowered back to its stowed position, the platen bridge module may be raised from its stowed position to the operating position. While in the operating position, the platen bridge module may occupy or fill the service bay 436 such that it creates a relatively flush or seamless transition from the first portion 434*a* of the platen to the second portion 434*b* of the platen, in such an implementation, the platen bridge module may prevent print media from getting caught or jamming in the service hay 436 as it is delivered through the print zone or under the printhead in the imaging device 401.

What is claimed is:

1. A service station, comprising:

a conveyor movable along a conveyor path;

a first service module removably installed on the conveyor;

a second service module removably installed on the conveyor, the conveyor to move the first service module and the second service module along the conveyor path; and a lifter disposed in a lifting zone along the conveyor path to lift one of the first service module and the second service module from a stowed position to an operating position if the first service module or the second service module is disposed in the lifting zone along the conveyor path, the lifting zone disposed under a service bay disposed between a first portion and a second portion of a platen.

2. The service station of claim 1, wherein the first service module and the second service module are part of a plurality of service modules removably installed on the conveyor, each service module of the plurality of service modules movable from the stowed position to the operating position.

3. The service station of claim 2, wherein each service module of the plurality of service modules is individually removable from the conveyor.

4. The service station of claim 2, wherein the conveyor further comprises a drive member to drive the plurality of service modules along the conveyor path.

5. The service station of claim 4, wherein the conveyor further comprises a track, the drive member to drive the plurality of service modules along the track to move the plurality of service modules along the conveyor path.

6. The service station of claim 5, further comprising an agitator to move one of the plurality of service modules through an operating motion if the one of the plurality of service modules is disposed in the operating position.

7. The service station of claim 1, the conveyor to move the first service module and the second service module along the conveyor path including in a first direction substantially parallel with the platen, and the lifter to lift the one of the first service module and the second service module in a second direction substantially perpendicular to the first direction.

8. A service station, comprising:

a plurality of individually removable service modules disposed on a conveyor;

a drive member to move the conveyor along a conveyor path including in a conveying direction substantially parallel with a platen; and a lifter to individually lift one of the plurality of service modules from a stowed position to an operating position including in a lifting direction substantially perpendicular to the conveying direction if the one of the plurality of service modules is disposed in a lifting zone along the conveyor path.

9. The service station of claim 8, the lifter comprising:

a slider; and a cam engaged with the slider, the cam to push the slider from a first position to a second position such that the slider lifts one of the plurality of service modules from the stowed position to the operating position during the transition of the slider from the first position to the second position.

10. The service station of claim 9, further comprising an agitator to move one of the plurality of service modules through an operating motion if the one of the plurality of service modules is disposed in the operating position, the agitator comprising:

an agitator bar;

a pivot arm having a first end engaged with the slider and pivotable about a second end; and a drive train disposed on the pivot arm and engaged with a transmission of the service station, the drive train removably engageable with the agitator bar.

11. The service station of claim 10, wherein the slider is to move the pivot arm about the second end during the transition of the slider from the first position to the second position to engage the drive train with the agitator bar.

12. The service station of claim 11, wherein the drive train includes a drive gear to engage with a gear rack of the agitator bar if the drive train is engaged with the agitator bar, the transmission and drive train to move the agitator bar through the operating motion.

13. The service station of claim 10, the operating motion substantially perpendicular to the lifting direction.

14. The service station of claim 8, the lifting zone disposed underneath a service bay, and the service bay disposed between a first portion and a second portion of the platen.

15. The service station of claim 8, the drive member to move the conveyor along the conveyor path relative to the platen.

16. An imaging device, comprising:

a platen disposed under a printhead, the platen having a first portion and a second portion, and a service bay disposed in between the first portion and the second portion; and a service station disposed underneath the platen, comprising:

a plurality of service modules removably installed on a conveyor, the plurality of service modules movable along a conveyor path into and out of a lifting zone disposed underneath the service bay; and a lifter disposed in the lifting zone to lift one of the plurality of service modules from a stowed position to an operating position if the one of the plurality of service modules is disposed in the lifting zone.

17. The imaging device of claim 16, wherein the plurality of service modules is disposed underneath the platen in the stowed position and is disposed in the service bay in the operating position.

18. The imaging device of claim 17, wherein each of the service modules of the plurality of service modules is individually removable from the service station and is a different type of service module from the other service modules of the plurality of service modules.

19. The imaging device of claim 17, wherein one of the plurality of service modules is a platen bridge module, the platen bridge module to be disposed flush with the platen within the service bay if the platen bridge module is disposed in the operating position.

20. The imaging device of claim 17, wherein one of the plurality of service modules is a wiper module, the wiper module to wipe a nozzle of the printhead if the wiper module is disposed in the operating position.

* * * * *